US007806039B1

(12) United States Patent
Gomez

(10) Patent No.: US 7,806,039 B1
(45) Date of Patent: Oct. 5, 2010

(54) FIREARM WITH FACILITY FOR OPEN-BOLT AND CLOSED-BOLT OPERATION

(75) Inventor: Jesus S Gomez, St. Fredericksburg, VA (US)

(73) Assignee: LWRC International, LLC, Cambridge, MD (US)

( * ) Notice: Subject to any disclaimer, the term of this patent is extended or adjusted under 35 U.S.C. 154(b) by 610 days.

(21) Appl. No.: 11/825,221

(22) Filed: Jul. 5, 2007

(51) Int. Cl.
*F41A 19/33* (2006.01)
*F41C 7/00* (2006.01)

(52) U.S. Cl. ..... 89/132; 89/138; 89/144; 89/149

(58) Field of Classification Search ..... 89/132, 89/137, 138, 139, 140, 144, 149
See application file for complete search history.

(56) References Cited

U.S. PATENT DOCUMENTS

| | | | | | |
|---|---|---|---|---|---|
| 2,482,758 | A | * | 9/1949 | Gaidos | 89/140 |
| 2,858,741 | A | * | 11/1958 | Simpson | 89/140 |
| 2,872,849 | A | * | 2/1959 | Simpson | 89/140 |
| 3,446,114 | A | * | 5/1969 | Ketterer | 89/140 |
| 3,618,455 | A | * | 11/1971 | Plumer et al. | 89/132 |
| 4,057,003 | A | * | 11/1977 | Atchisson | 89/138 |
| 4,128,042 | A | * | 12/1978 | Atchisson | 89/138 |
| 4,433,610 | A | | 2/1984 | Tatro | |
| 2007/0051236 | A1 | | 3/2007 | Groves et al. | |

OTHER PUBLICATIONS

Journal Article: *The Small Arms Review*, vol. 10, No. 9, Jun. 2007, pp. 83-88, "The German FG-42".

* cited by examiner

*Primary Examiner*—Bret Hayes
(74) *Attorney, Agent, or Firm*—Bennet K. Langlotz; Langlotz Patent & Trademark Works, Inc.

(57) ABSTRACT

A firearm has a frame with a barrel connected to the frame and defining a barrel axis. The barrel has a rear end defining a chamber, and a bolt assembly reciprocates with respect to the chamber between a closed position adjacent the chamber, and an open position away from the chamber. A fire control assembly includes a trigger and a selector switch with a semi-automatic position and a fully-automatic position. The fire control assembly includes a bolt assembly sear operably engaging the bolt. The fire control assembly operates when the selector switch is in the semi-automatic position in response to pulling the trigger to discharge the firearm, to load a cartridge, and to position the bolt in the closed position. The fire control assembly operates when the selector switch is in the fully-automatic position in response to pulling the trigger to discharge the firearm, and to hold the bolt in the open position. The fire control may include a sub-frame connected to the frame and to the bolt assembly sear, and may include a safety sear that prevents firing out of battery when in either full-auto or semi-auto modes. The fire control system may include a facility that momentarily maintains the trigger in a firing position when it is released while the bolt is moving forward from the open position.

16 Claims, 20 Drawing Sheets

FIREARM WITH FACILITY FOR OPEN-BOLT AND CLOSED-BOLT OPERATION

FIELD OF THE INVENTION

This invention relates to the firearms, and more particularly to select-fire rifles.

BACKGROUND AND SUMMARY OF THE INVENTION

Certain firearms may operate to fire either from an open bolt configuration or a closed bolt configuration.

Open bolt operation proceeds with a trigger pull causing a retracted bolt to move forward, stripping a cartridge from a magazine or belt, chambering the cartridge, and firing the cartridge. In response to firing one or more rounds, the bolt is forced back to the open position, where it is held until the trigger is pulled again. Open bolt arms have the advantage of allowing the barrel and chamber to cool more readily after sustained firing by keeping the chamber open. They avoid the risk of "cook-off," which occurs when a cartridge is chambered into a very hot chamber, and heated to the point of ignition, causing the rifle to discharge even when the trigger is not pulled and a safety is engaged. Open bolt arms also prevent the lead core of a chambered projectile from melting away from the copper jacket, thus preventing damage to the barrel or barrel mounted sound suppressors.

Open bolt arms suffer the disadvantage of increased susceptibility to dirt and contamination entering the action and chamber, because the bolt is normally open and exposes these areas to the environment. Open bolt arms are considered less accurate for aimed fire, because the abrupt motion of the heavy bolt after trigger pull (but before discharge) tends to disrupt the aim of the firearm.

A further disadvantage of open bolt firearms is the increased risk of a malfunction at a critical moment when a first shot is needed. This is because every step of firearm operation has some small percentage risk of failure, and open bolt firing requires not just that the cartridge properly discharge when struck by the firing pin, but that the cartridge be properly stripped, fed, and chambered, each of which has some risk of malfunction.

Closed bolt operation, on the other hand, suffers the risk of cook-off, but enjoys the advantages of accuracy and reliability. Accuracy is provided because the bolt remains stationary up until the trigger is pulled and discharging of the cartridge has occurred. Reliability is provided because the risks of feeding the cartridge may be undertaken before the critical moment, allowing any malfunction to be addressed before encountering a threat, and because the action is closed to keep out contaminants.

Therefore, closed bolt firearms are generally used for semi-automatic applications, while open bolt arms tend to be used for fully-automatic applications, where accuracy is less critical, and cook-off is a greater concern.

Firearms have been developed that employ both open and closed bolt operation modes. One example is the German FG-42, a World War II era machine gun that employed select fire operation (allowing a choice of semi and full automatic) and which fired from an open bolt position during full automatic fire, and from a closed bolt position during semi-automatic operation. A change lever engages one of two sears depending on the mode of fire selected.

Modern firearms have been disclosed that employ open and closed bolt operation. For instance, US Patent Application Publication 2007/0051236 to Groves et al. discloses a weapon platform that operates in open bolt mode on full auto, and closed bolt when the selector switch is set to semi-auto mode. This disclosure, incorporated herein by reference, discloses a feature of allowing the user to switch from open-bolt/full-auto mode to Semi-auto without the bolt closing, avoiding the noise of bolt closure, which may be disadvantageous in certain circumstances. Of course, this means that the rifle suffers the inaccuracy and other disadvantages of open bolt operation on the first shot from semi-auto after transitioning from open bolt auto operation.

The above disclosure suffers from several other disadvantages. First, it is not adaptable to update or improve the many existing lower receivers (which contain the fire control group, support a grip, and receive a magazine) for these arms, and requires that an entire new lower receiver be supplied. Second, the pivot pins employed are supported only by the relatively thin bodied aluminum, steel or polymer composite material used for the lower receiver. The stresses generated by the reciprocating bolt that interacts with the fire control components can damagingly stretch the holes that hold the pivot pins that support the components. Third, while the auto sear prevents discharge with the bolt out of battery, it has no safety effect to prevent out-of battery discharge when the rifle is in semi-auto mode.

The present invention overcomes the limitations of the prior art by providing a firearm having a frame with a barrel connected to the frame and defining a barrel axis. The barrel has a rear end defining a chamber, and a bolt assembly reciprocates with respect to the chamber between a closed position adjacent the chamber, and an open position away from the chamber. A fire control assembly includes a trigger and a selector switch with a semi-automatic position and a fully-automatic position. The fire control assembly includes a bolt assembly sear operably engaging the bolt. The fire control assembly operates when the selector switch is in the semi-automatic position in response to pulling the trigger to discharge the firearm, to load a cartridge, and to position the bolt in the closed position. The fire control assembly operates when the selector switch is in the fully-automatic position in response to pulling the trigger to discharge the firearm, and to hold the bolt in the open position. The fire control may include a sub-frame connected to the frame and to the bolt assembly sear, and may include a safety sear that prevents firing out of battery when in either full-auto or semi-auto modes. The fire control system may include a facility that momentarily maintains the trigger in a firing position when it is released while the bolt is moving forward from the open position.

DETAILED DESCRIPTION OF A PREFERRED EMBODIMENT

Figure 1:
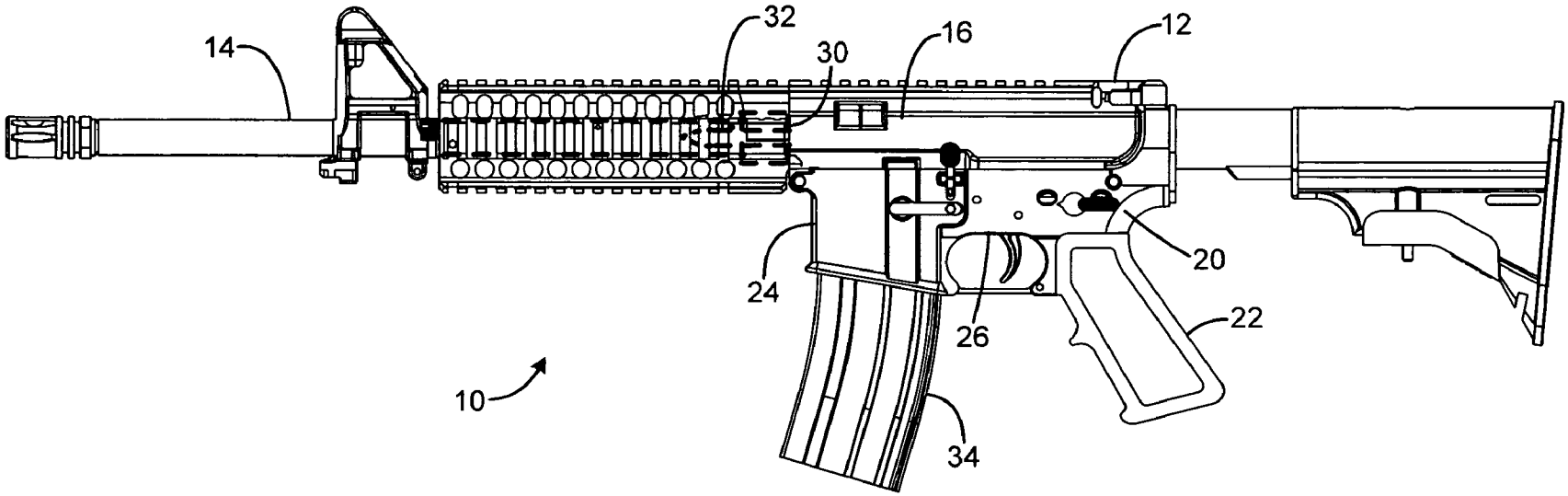
FIG. 1 is a side view of a rifle according to a preferred embodiment of the invention.

FIG. 1 shows a select fire rifle 10 in the pattern of an M-16, AR15, M4 or AR10. The rifle has an upper receiver 12 that contains a barrel 14, and a reciprocating bolt assembly 16 (which may also be referred to as a "bolt"). The rifle has a lower receiver 20 having a grip 22, magazine well 24, and a housing portion 26 in which fire control elements reside, as will be discussed below. The barrel has a rear end 30 defining a chamber 32 into which cartridges are fed from a detachable magazine 34 during operation.

Figure 2:
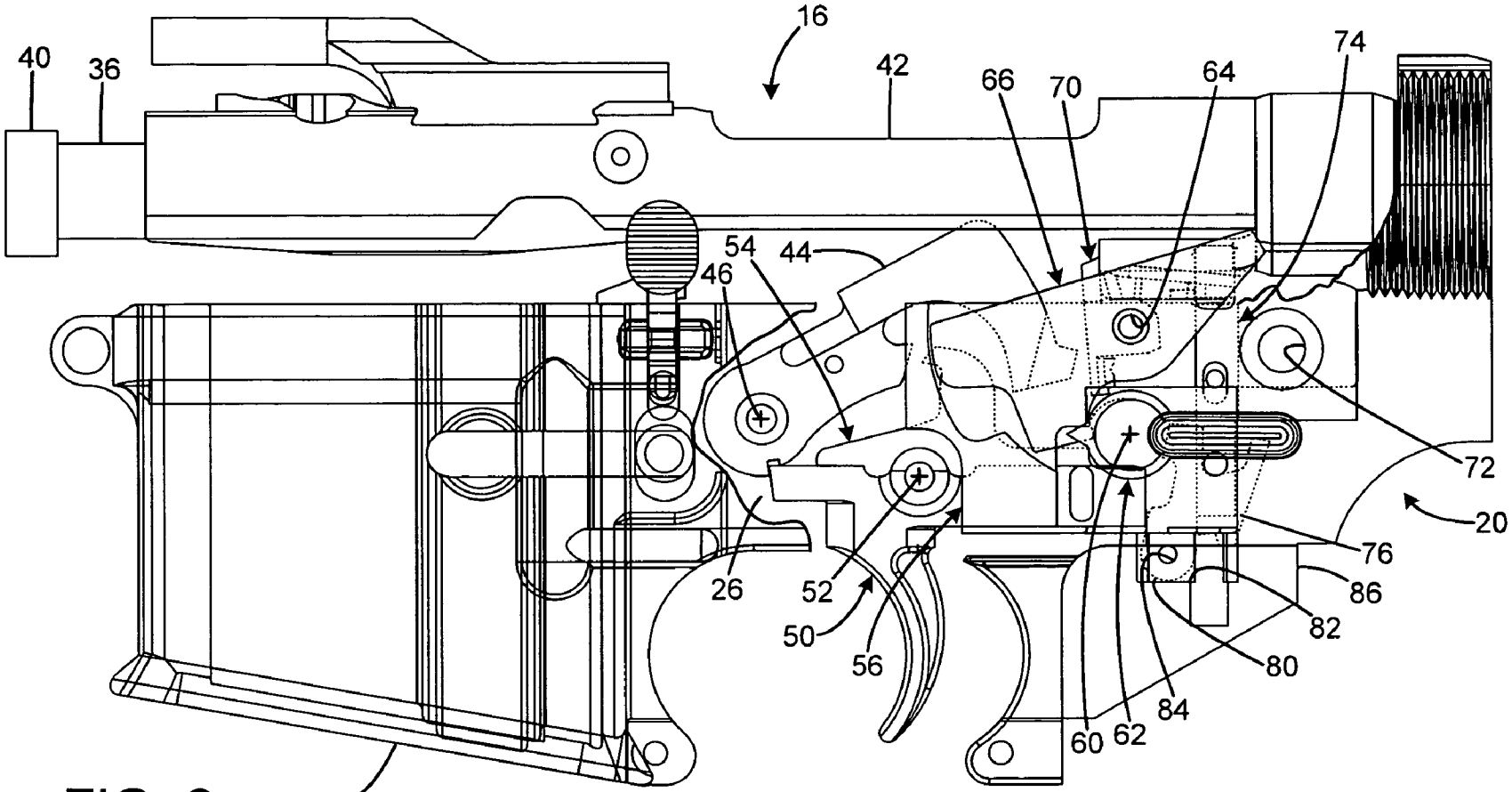
FIG. 2 is an enlarged side sectional view a rifle according to a preferred embodiment of the invention.

FIG. 2 shows the lower receiver 20 in greater detail, with certain conventional rifle parts omitted. The bolt assembly 16 includes a bolt 36 having a bolt head 40 that protrudes forwardly for interaction with the barrel 14. The bolt reciprocates within a bolt carrier 42. The bolt assembly reciprocates between a forward position (shown) in which the bolt head engages the chamber, and a rearward position in which the bolt head is to the rear of the magazine well, so that it may strip a cartridge from the magazine while moving forward, and thereby chamber the cartridge.

The lower receiver is essentially conventional, and formed of Aluminum or reinforced polymer. The housing portion 26 defines a chamber between opposite major sidewalls for receiving the moving parts of the fire control group. The sidewalls define a number of holes that pass entirely through the body, and these holes receive pivot pins that support the pivoting movement of various fire control components.

A hammer 44 is pivotally connected to the frame at a first pivot pin 46, and is a conventional military specification hammer. A steel trigger element 50 is pivotally attached to the frame at a second pivot pin 52, which also supports a disconnector 54. An internal subframe 56 substantially fills a rear portion of the housing chamber and supports a number of other fire control components. The subframe is formed of steel or other high-strength material that is stronger and harder than the receiver material.

The housing defines a circular selector through hole on a selector pivot axis 60 it receives a steel selector switch 62 that appears superficially conventional, except that the geometry of its internal portion is specially designed to control the function of the preferred embodiment of the invention. The housing and subframe define a through hole 64 above the selector hole, and this receives a pivot pin that supports a bolt sear element 66 and a safety sear 70. The lower receiver further defines a rear hole 72 that receives a takedown pin for attaching the upper receiver to the lower receiver. A front hole 73 also receives a takedown pin. An elongated cylindrical plunger 74 is oriented vertically rearward of the selector, and forward of the rear takedown pin. The plunger is closely received in a bore of the subframe, for vertical reciprocation as will be discussed below. A trigger block element 76 has a lower end 80 received within a pocket 82 formed in the floor of the frame's chamber, and pivots on a horizontal pin received within a hole 84 that is drilled in the tang 86 that supports the grip handle. For newly-made receivers, as opposed to retrofitting the system into existing receivers, hole 64 in the receiver for the auto sear may be omitted, as the safety sear is supported within the sub-frame as will be illustrated below. However, this hole 64 in the receiver may also be used as a means of retention of the fire control group when the gun is taken down, such as with a spring loaded detent within the pin.

Figure 3:
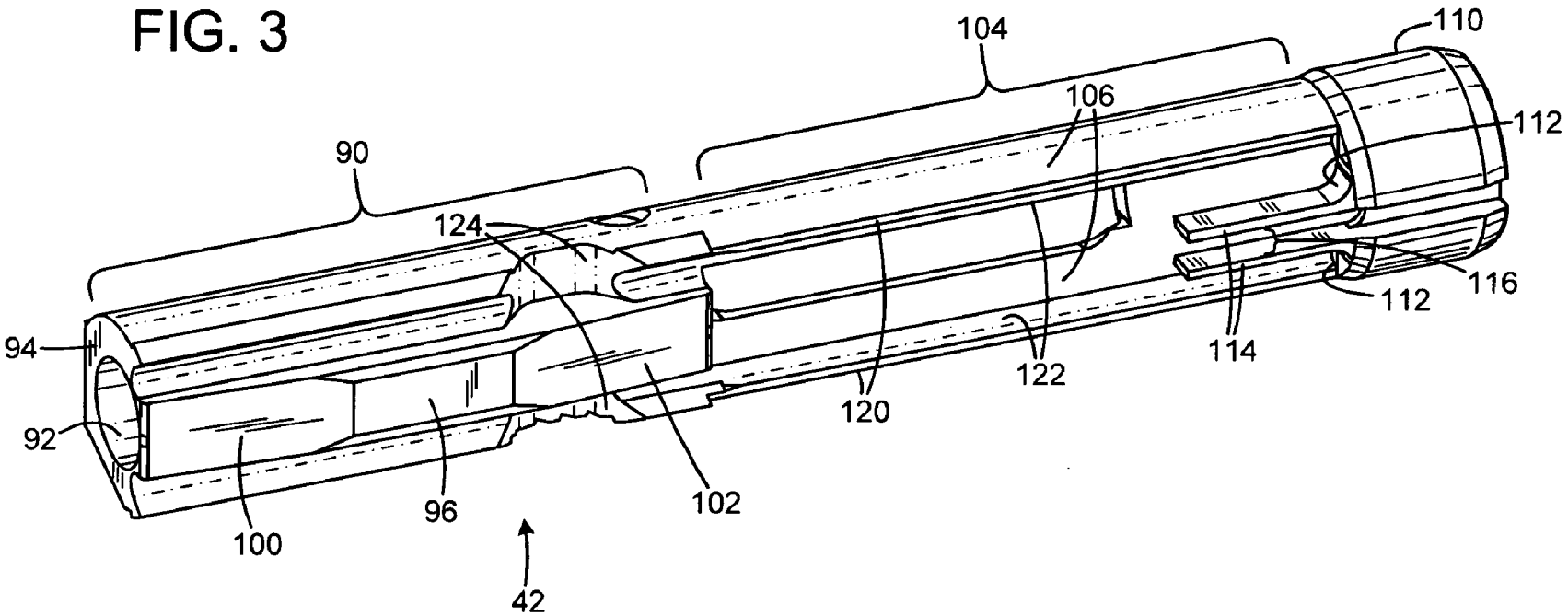
FIGS. 3-11 are perspective views of components of the preferred embodiment of the invention.

FIG. 3 shows the steel bolt carrier 42, which has a forward portion 90 defining an axial bore 92 that receives the bolt, and has an opening at a forward face 94 of the bolt carrier. The forward portion 90 has a lower surface that bulges with respect to the length of the bolt carrier, with a protruding central surface 96 that is contiguous with a forward ramp 100 and a rear ramp 102, which slope slightly with respect to the length of the bolt carrier. A rear portion 104 of the bolt carrier has an open central portion enclosed only by opposed sidewalls 106. A rearmost portion 110 is an enlarged cylindrical body having a forward face 112, from which a pair of adjacent protrusions 114 extend in a forward direction with a gap 116 between the protrusions. The sidewalls 106 each have straight lower edges 120, with a step 122 formed at the level of the lower edges on each side, medially from each lower edge. Each step of forms a channel that extends forward to a bolt sear engagement surface 124. The bolt sear engagement surfaces 124 face in a direction angled forward and downward.

Figure 4:
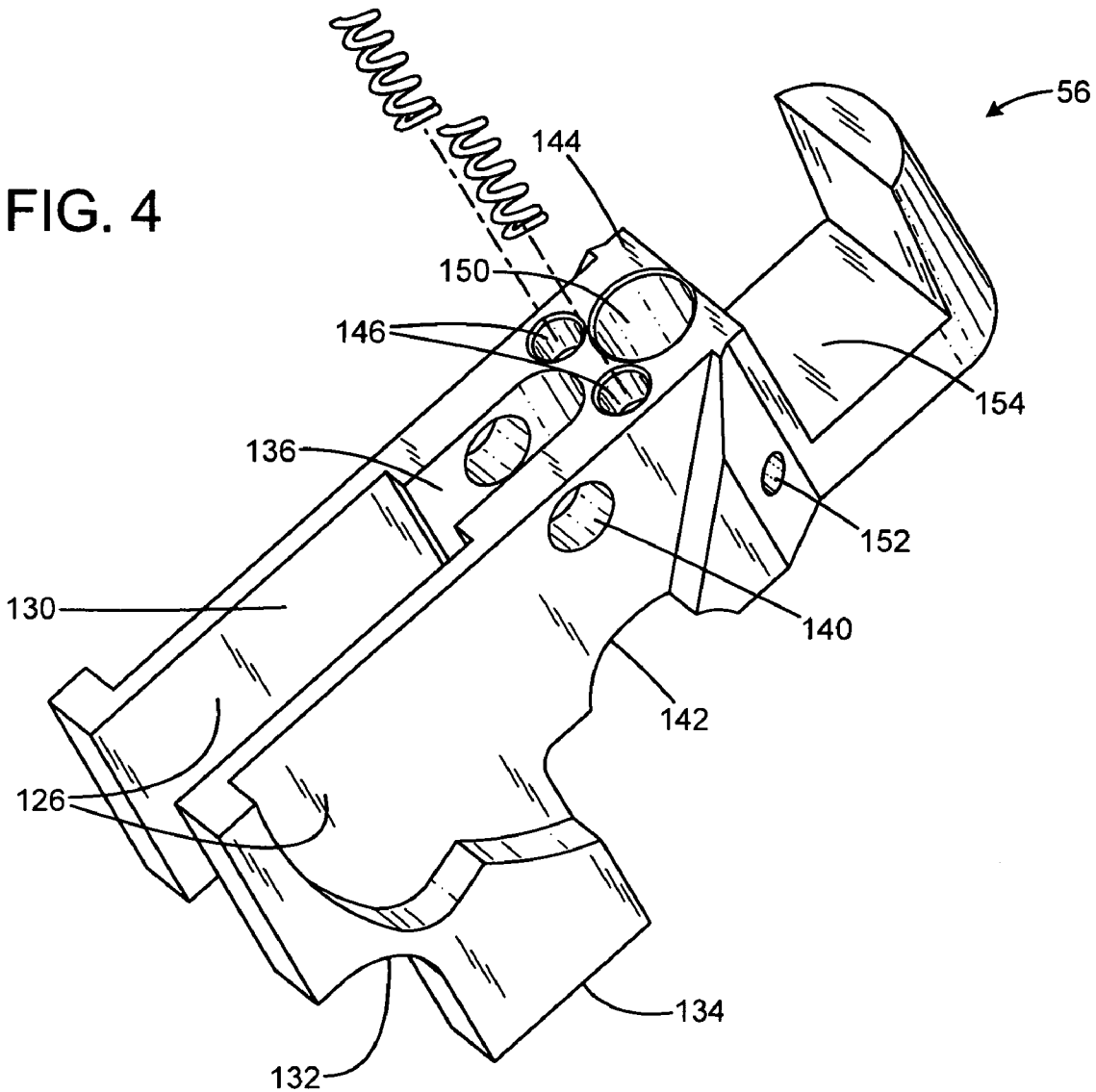

FIG. 4 shows the subframe 56. The subframe has a forward portion having spaced apart vertical parallel sidewalls 126 defining a hammer clearance pocket 130 between them. A trigger clearance cut 132 is formed at the lower front corner of each sidewall, and alignment legs 134 provide the lowest surface of each sidewall. The subframe defines a safety sear pocket 136 that is narrower than and to the rear of the hammer clearance pocket 130 and also contains an integral spring pocket. A main axle pin through hole 140 is defined laterally through the subframe at the safety sear pocket. A selector clearance cut 142 is provided below the through hole 140. An upper surface 144 of the subframe defines a pair of symmetrically positioned vertical bolt sear spring pockets 146. A reconnector plunger through hole 150 passes vertically through the subframe, just rear of the carrier sear spring pockets 146. A reconnector plunger and spring retaining roll pin through hole 152 extends laterally through the subframe in line with hole 150, at a lower intermediate portion of the subframe. At the rear of the subframe, a large, upward facing channel 154 provides a pocket for receiving the rear lug of the upper receiver.

Figure 5:
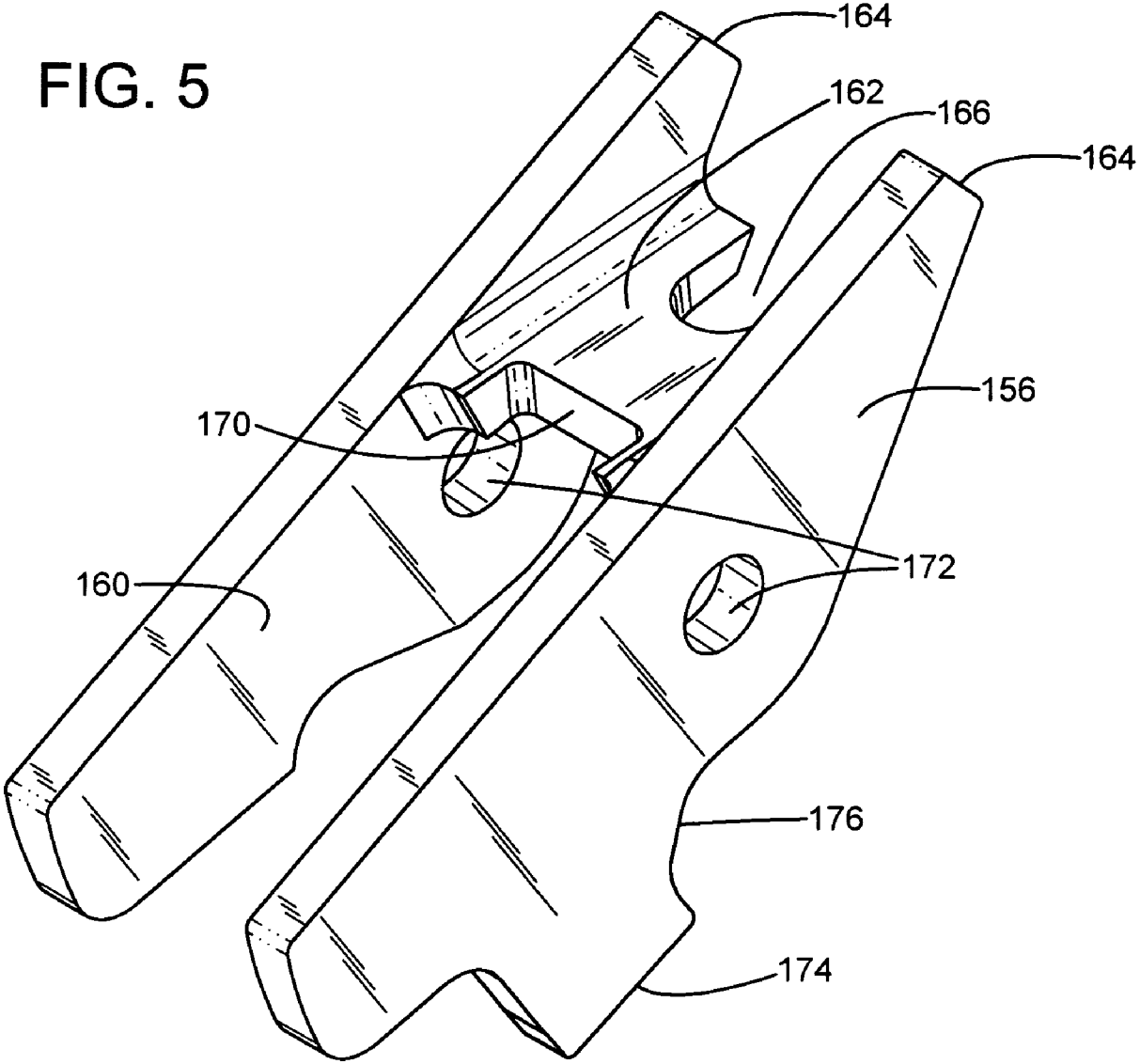

FIG. 5 shows the bolt sear element 66. This is formed of steel, with opposed parallel sidewalls 156, 160 that are connected by a center span 162 at the rear of the element. The rear tips of each sidewall provide carrier's sear engagement surfaces 164. The rear of the center span includes a reconnector plunger clearance cut 166, and the front of the center span includes a safety sear clearance cut 170. The sidewalls have registered axle pin through holes 172. The left sidewall 156 has a lower protrusion 174 that provides a trigger force transfer surface near the forward end of the sidewall. To the rear of the surface 174 is an angled selector camming surface 176, which is approximately radially aligned with hole 172.

Figure 6:
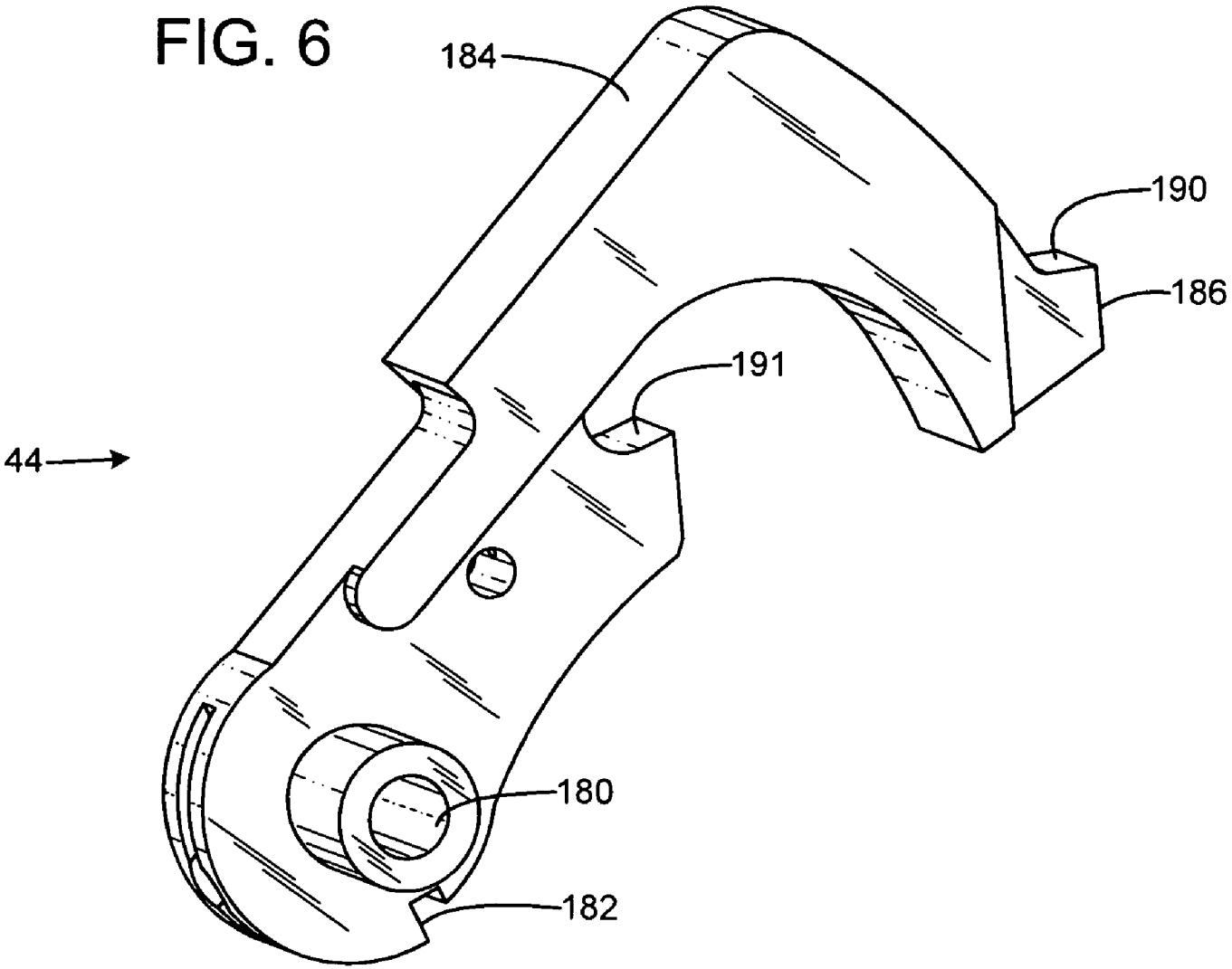

FIG. 6 shows a conventional steel hammer 44 having a pivot hole 180, a trigger engagement hook 182 adjacent to the whole 180, a striking face 184, and a hook 186 having an auto sear engagement surface 190 at the end of the hammer opposite the hole 180. A disconnector hook surface 191 is provided at an intermediate distance from the pivot hole.

Figure 7:
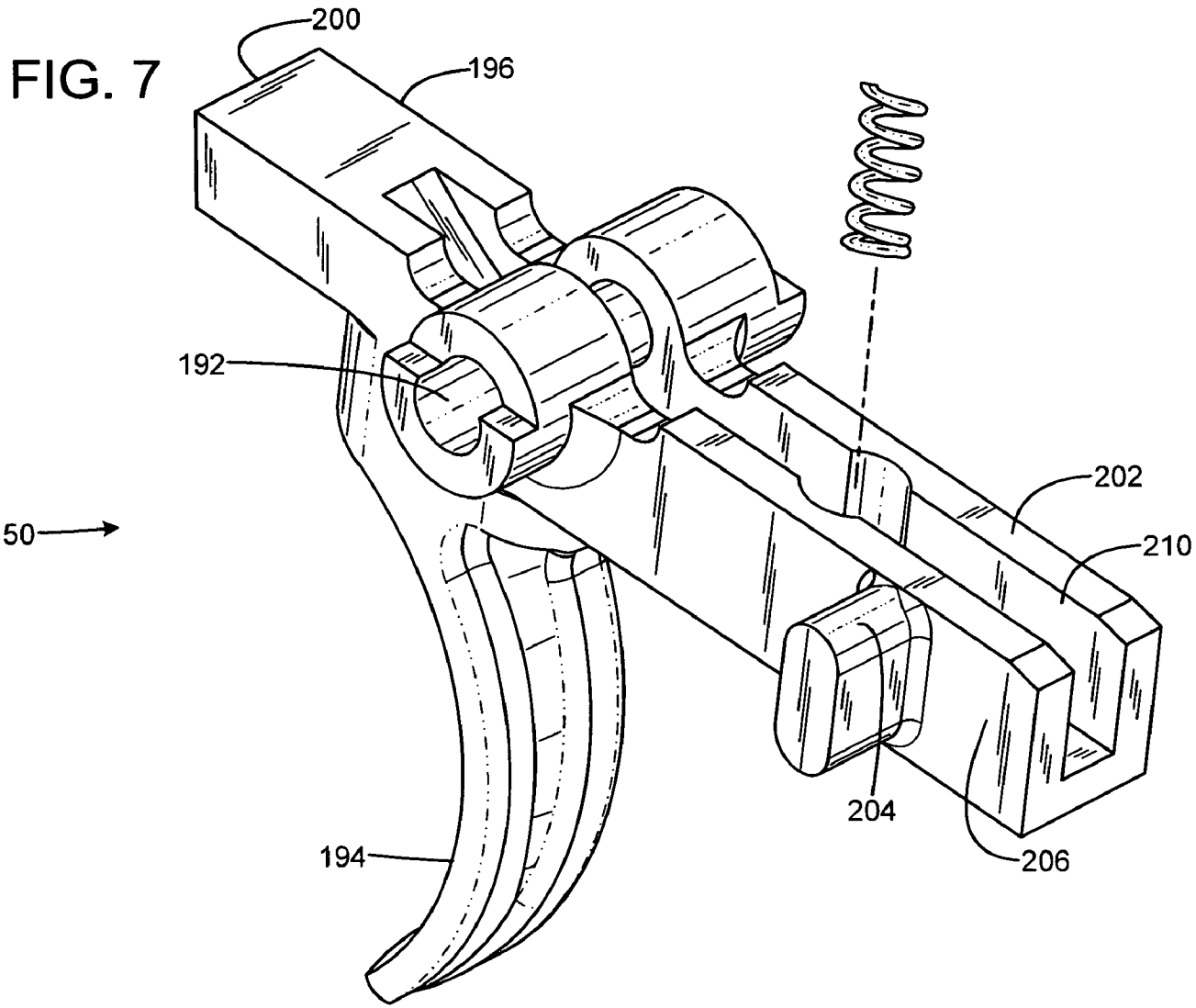

FIG. 7 shows the trigger 50, which defines a pivot hole 192, and which has a downwardly extending trigger lever 194, and a forward extending portion 196 having a sear edge 200. A rear extension 202 extends rearward from the hole 192, and a boss 204 protrudes laterally from the left surface 206 of the rear extension, near the rear end of the extension. An upwardly open medial slot 210 extends nearly the length of the trigger element to receive a disconnector.

Figure 8:
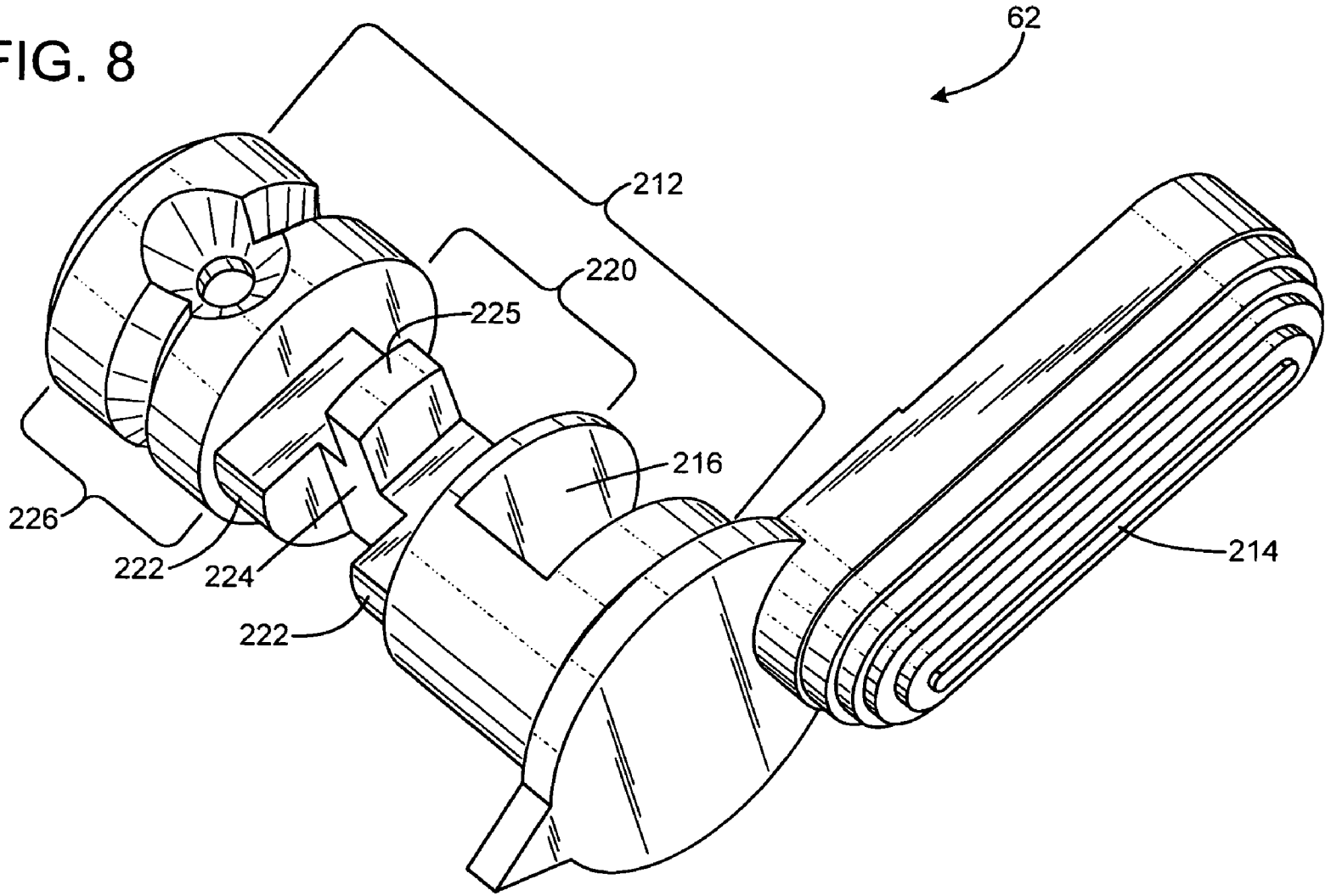

FIG. 8 shows the selector switch 62, which has a cylindrical body 212 and a perpendicular handle 214. The selector switch is conventional in form, except that it has several surfaces that are particular to the preferred embodiment. Near the handle, a deep cut out 216 provides for carrier sear cam engagement. A central portion 220 includes right and left portions 222 that provide conventional safety functions by engagement with the rear portion of the trigger. A central cut out 224 provides for trigger block cam engagement. An end portion 226 includes a groove and recesses for detent engagement.

Figure 9:
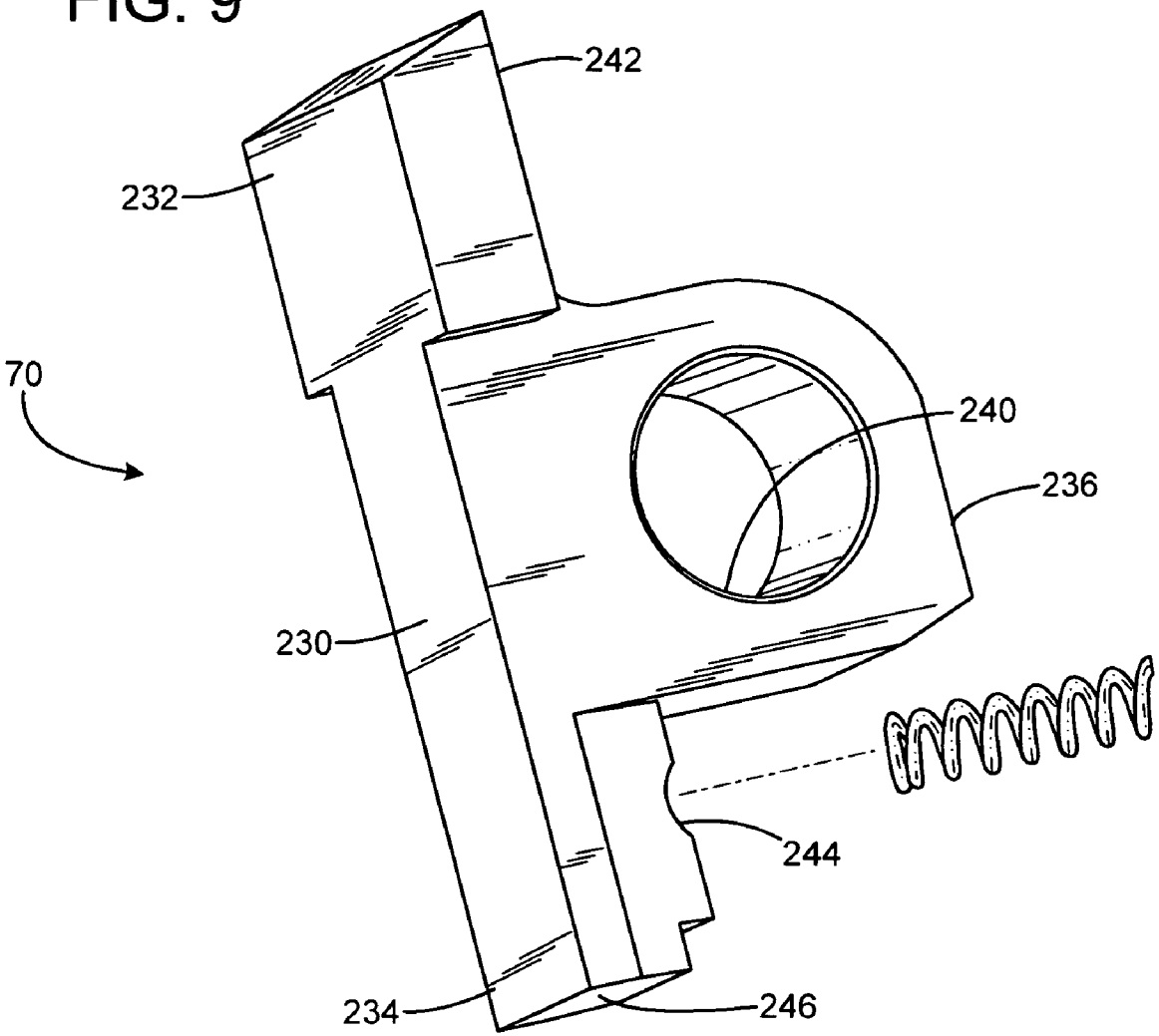

FIG. 9 shows the safety sear 70, which includes an elongated bar 230 having an upper end 232 and a lower end 234.

A boss 236 defining a lateral pivot hole 240 extends from the rear surface of the bar at an intermediate position. A rear surface 242 of the upper portion provides a carrier trip impact surface, a rear surface 244 of the lower portion includes a spring pocket, and the end surface 246 of the lower and provides a hammer engagement surface.

Figure 10:
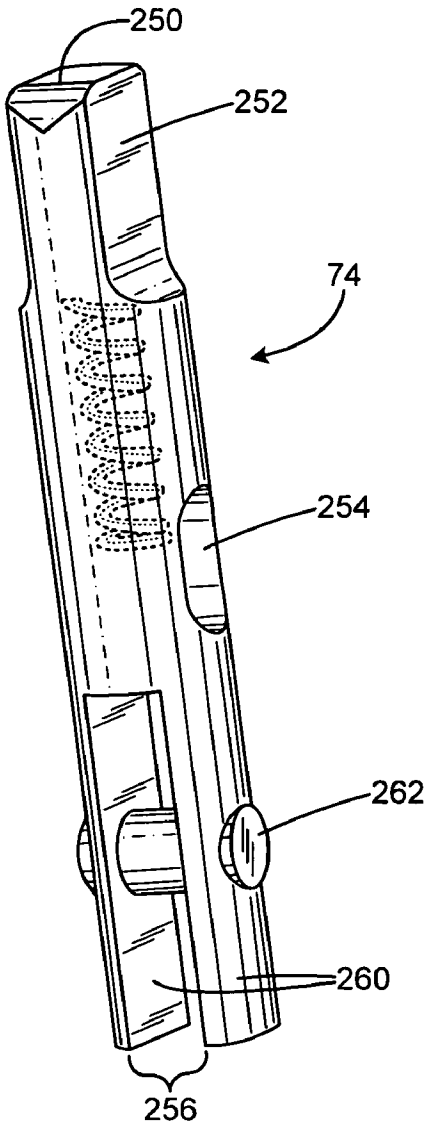

FIG. 10 shows the reconnector plunger 74. The plunger formed of steel, and is an elongated cylindrical body having an upper end surface 250 providing a carrier camming surface, with parallel opposed flats 252 providing carrier clearance. At an intermediate portion, an elongated retaining pin through hole 254 extends laterally through the plunger, and is elongated in line with the axis of the plunger, so that the plunger may reciprocate by a limited amount with respect to a pin within the hole. The lower portion of the plunger is provided with a substantial slot 256 that provides two opposed legs 260 for constraining the trigger block, as will be discussed below. At an intermediate portion along the length of legs, a hole is drilled through both legs, and occupied by a trigger block camming pin 262. A reset spring (not shown) is contained within the body of the plunger.

Figure 11:
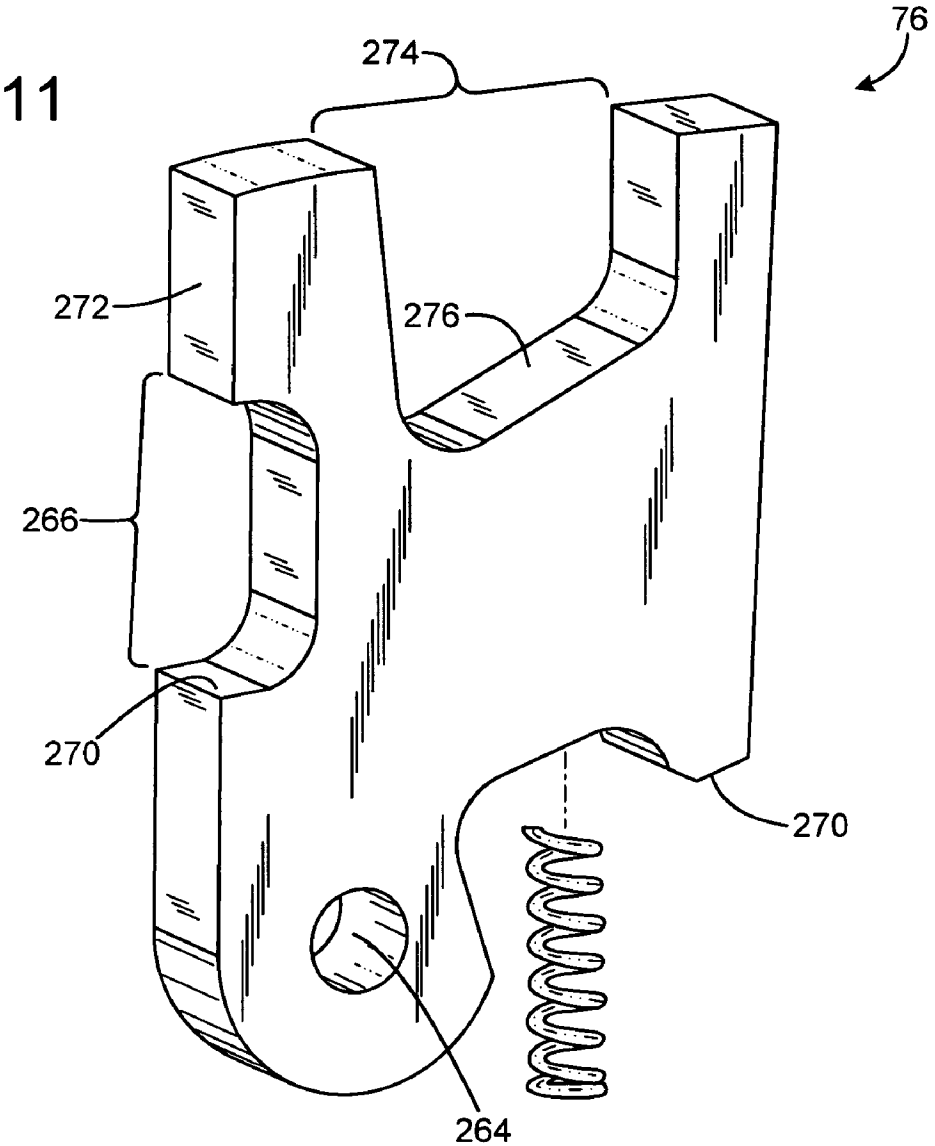

FIG. 11 shows the trigger block 76, which is a small plate having a generally rectangular shape. A pivot pin through hole 264 is provided at a lower forward portion of the block. An intermediate portion of the forward edge of the block is provided with a cut out 266. An upward facing surface 270 at the lower end of the cut out provides a trigger engagement surface. The uppermost portion of the forward surface is a selector camming surface 272. A cut out 274 is provided in the upper edge of the trigger block, and the base of the cut out is an upward and slightly forward facing camming surface 276 that interacts with the reconnector plunger camming pin 262, as will be discussed below. To the rear of the pivot pin 264, the lower surface of the block includes a downward facing spring support face 280.

The firearm may be assembled at the time of original manufacture, or the fire control system may be installed in an existing lower receiver of an M16/M4 or AR10 pattern rifles. Much of the installation procedure is the same as with a conventional rifle, except as noted. If a conventional lower receiver is used, the pocket 82 must be wheeled into the floor of the cavity. The Tang 86 is laterally drilled to create pivot pin hole 84. The trigger block 76 is installed in the lower receiver, with a coiled spring installed below the surface 280, and the pivot pin installed in hole 84 of the receiver and hole 264 of the trigger block. The trigger, disconnector, selector and hammer are installed in a conventional manner.

The subframe is then prepared for installation by installing the reconnector plunger in through hole 150, with a retaining pin installed through subframe hole 152 and elongated plunger hole 254. Coil springs are installed in spring pockets 146 on the upper surface of the subframe, the bolt sear is positioned astride the subframe with holes 172 registered with subframe hole 140, and the safety sear is positioned with its hole 240 registered with the subframe hole 140 bolt sear holes 172. The sub-frame is then inserted into the lower receiver. The upper receiver is then mated to the lower receiver via the forward pivot/take-down pin. The upper receiver assembly is pivoted onto the lower receiver with the upper receiver rear take-down lug resting within the 142 lug retaining pocket found on 144 Sub-frame. The rear 72 take-down pin is then installed through the holes to maintain position and securing the upper, lower and sub-frame together.

Sequence of Operations

The details of the operation of the invention are discussed below. The operation can be summarized as follows: the system may operate in a semiautomatic or fully automatic mode. In semiautomatic mode, each cycle starts and ends in a closed bolt condition. In fully automatic mode the cycle may start in either the open bolt or the closed bolt condition.

In semiautomatic mode, a conventional interaction between the trigger sear and hammer hook provide normal operation, with each shot generating the feeding of a subsequent round of ammunition. The system may be operated in fully automatic mode from several initial conditions. If the system is in a closed bolt condition with a cartridge chambered in semiautomatic mode, it may be switched to fully automatic mode. In this condition, pulling the trigger discharges the round in the chamber from a closed bolt condition, and then discharges subsequent rounds in a burst of fire that ends with the bolt in an open condition. In this condition, the bolt is ready to strip feet and fire the next round, and subsequent rounds in another burst.

When the chamber is empty and fully automatic fire is desired, the bolt may be locked back in the open position, and the rifle loaded and prepared for firing. This is the condition that would apply when a magazine is depleted under fully automatic fire, the bolt is locked back after the last shot, and the magazine is replaced with a full one, when in fully automatic mode, the system may be transition back to semiautomatic mode. This would be done in circumstances in which the barrel's chamber is relatively cool, and not after extensive automatic fire. This transition might be desired to put the rifle in a condition for more accurate fire from semiautomatic mode, or to close the action to prevent incursion of dirt or debris.

It may be desirable in some circumstances to transition the system from fully automatic to semiautomatic condition, and back again, just to close the bolt and achieve the advantages of a first fully automatic shot from a closed bolt. re Referring back to FIG. 2, the system is illustrated in a condition with the selector 62 set to safe, preventing movement of the trigger. The bolt is closed, in the forward position, and a cartridge would be loaded in the chamber. The hammer is cocked, with notch 182 engaging sear edge 200 on the trigger, and the force of a hammer spring biasing it in a forward direction, counterclockwise in this view. The upper portion 242 of the safety sear 70 is pressed forward by the end of protrusion 114 of the bolt carrier (as better seen in FIG. 12). This pressure is against the biasing force of a spring that presses forward on the spring pocket 244 of the safety sear. The plunger 74 is retained in hole 150 of the subframe, and a retaining pin in hole 152 limits axial movement of the plunger by passing through the elongated through hole 254. The plunger is spring biased upward so that the retaining pin contacts the bottom end of the hole 254, in the upper end of the plunger passes between protrusions 114 on the bolt carrier. The trigger block 76 is rotationally spring biased in a forward or counterclockwise direction, but is restrained in a rearward position by the associated portion of the cylindrical body 212 of the selector. The disconnector 54 is disconnected from surface 191 of the hammer. The sear engagement surfaces 164 of the bolt sear are riding in the rear ends of bolt carrier channels 122.

Figure 12:
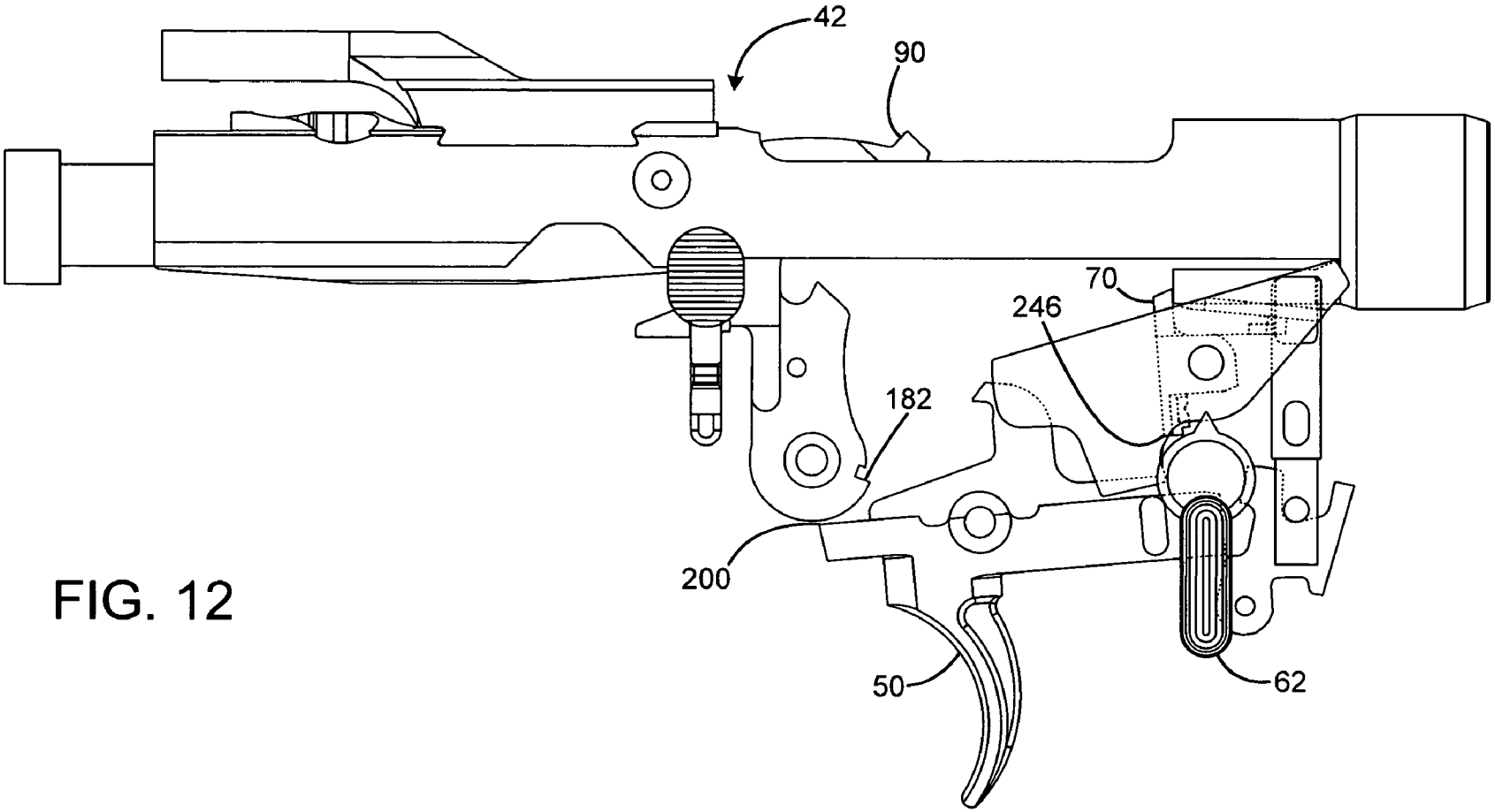
FIGS. 12-20 are side views illustrating the sequence of operations of the preferred embodiment.

FIG. 12 shows the next stage of operation in semiautomatic mode. The selector 62 has been set to semiautomatic, and the trigger 50 has been pulled. As the trigger is pulled, the sear edge 200 disengages from hammer hook 182, and the hammer pivots forward to strike the firing pin and discharge the chambered round. The hammer is free to swing forward because the hammer engagement surface 246 of the safety sear 70 is clear of the surface 190 at the end of the hammer. The selector continues to cam the trigger block and bolt carrier sear out of play in the semiautomatic setting.

Figure 13:
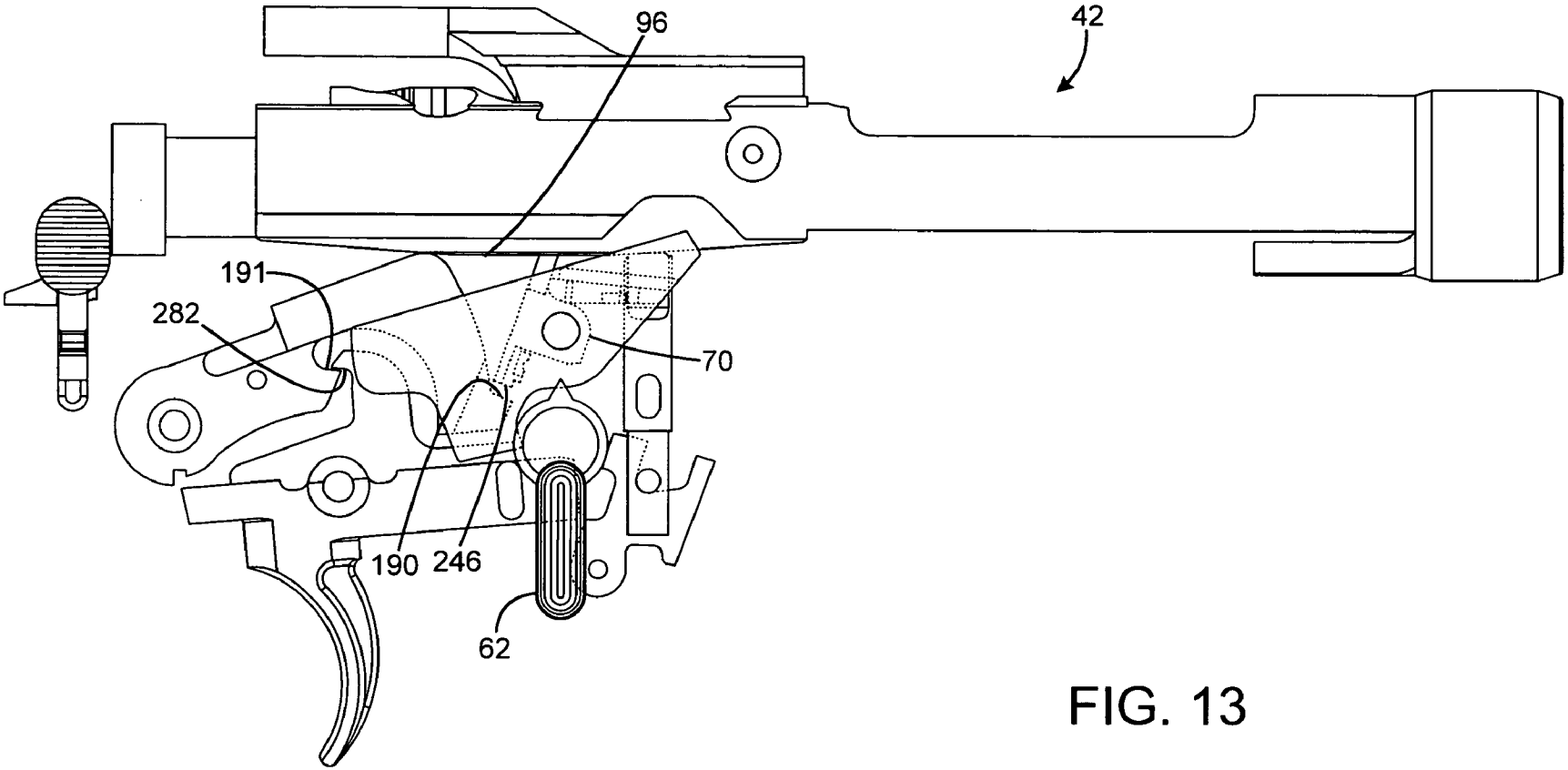

In FIG. 13, the next stage of operation in semiautomatic mode is shown. The bolt assembly 42 is now in full recoil. The lower surface 96 of the bolt has pushed the hammer downward so that hammer hook 191 has engaged the disconnector hook 282. The safety sear 70 has rotated clockwise under spring force so that the lower end 246 blocks the hammer and the surface 190, blocking the hammer until it is later tripped by the bolt carrier, only in full battery. The selector continues to keep the carrier sear and the trigger block cammed out of play. In this condition, the operator's finger will be on the trigger, holding it back even for a sustained time after the shot is fired.

Figure 14:
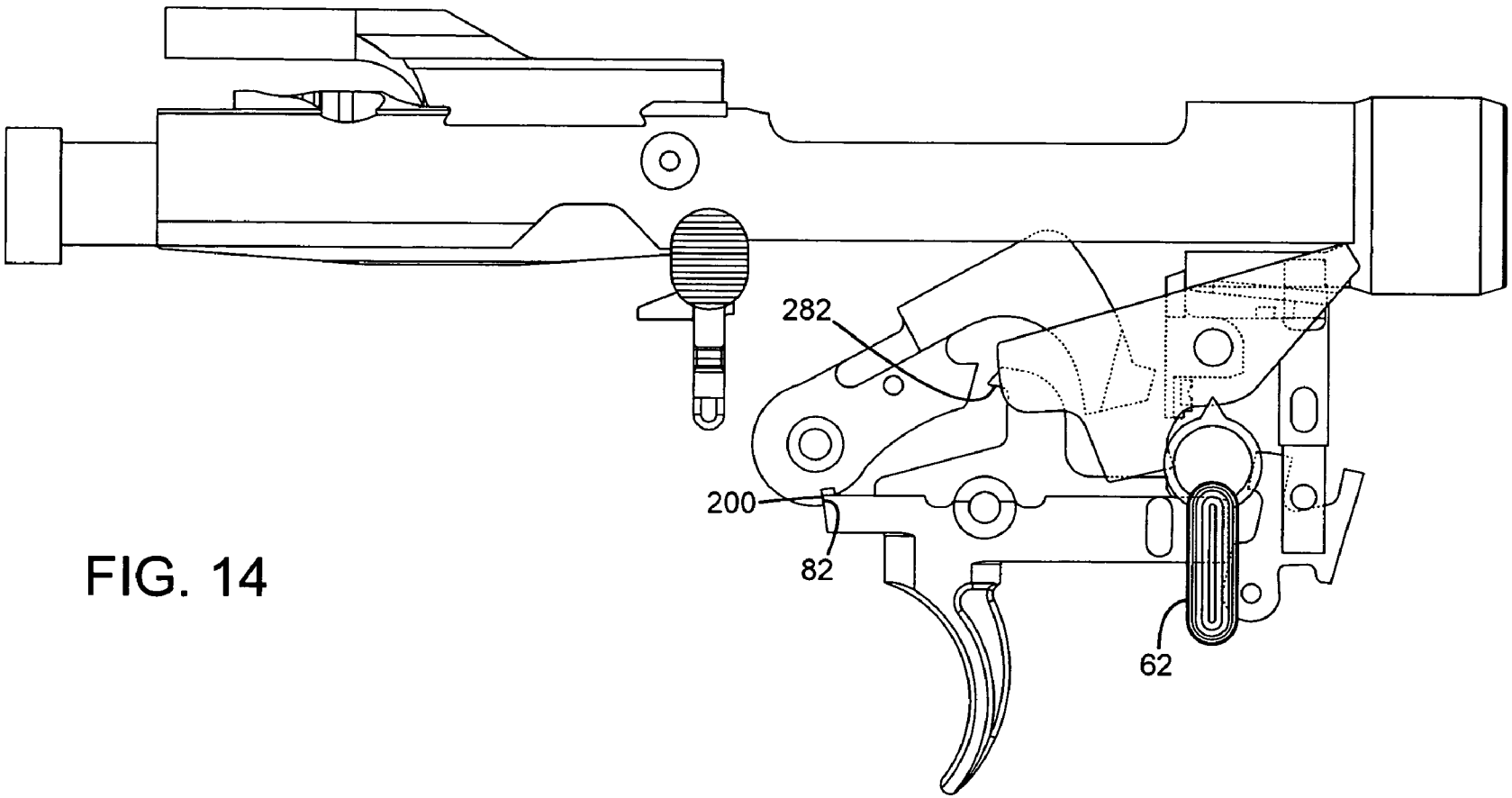

FIG. 14 shows the next stage of operation in semiautomatic mode. The operator has released pressure on the trigger, so that the disconnector hook 282 has disengaged from hammer, and be hammer hook 182 is engaged to the sear 200. In this condition, the system is ready for firing, and the sequence of FIGS. 12 through 14 would be repeated as desired by subsequent trigger pulls to generate single shots.

Figure 15:
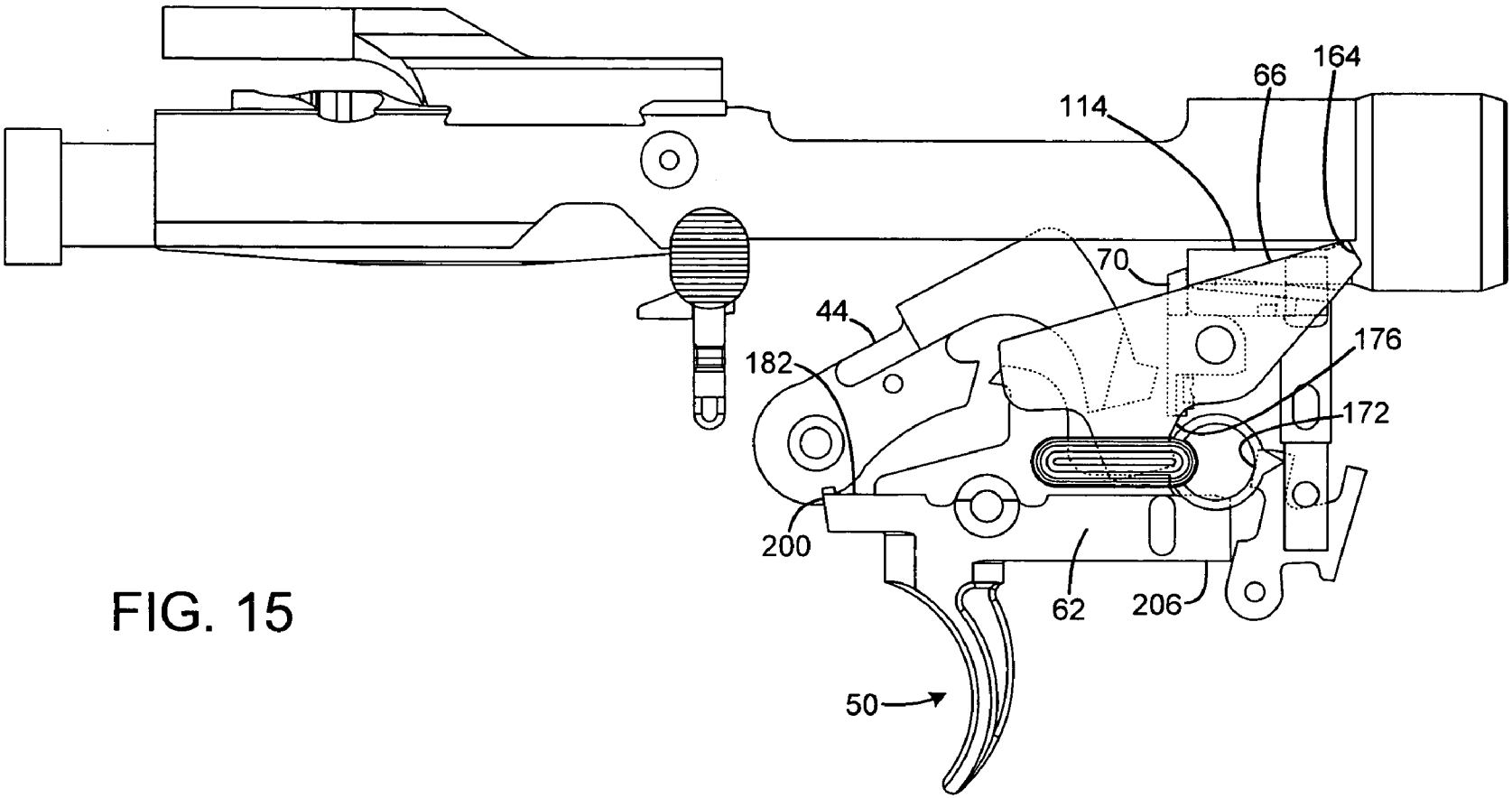

FIG. 15 shows the transition from semiautomatic to fully automatic mode. The bolt is closed on a loaded chamber following the last semiautomatic shot. The selector 62 has been pivoted by 90° from the semiautomatic position to the fully automatic position. Rotation of the selector has several effects. First, notch 224 (shown in FIG. 8) now faces the trigger block camming surface 272, no longer preventing the trigger block from pivoting forward. However, because the trigger 50 is in the reset position, the rear end 206 prevents the trigger block from rotating forward. The rear ends 164 of the carrier sear 66 continue to ride in channels 122 on the bolt carrier. As above, the protrusion 114 of the bolt carrier has shifted the safety sear 70 to a position the allowing movement of the hammer 44, because the bolt is fully in battery. With the selector in the fully automatic position, the cut out 216 on the cylindrical portion allows the selector camming surface 176 to pass, so that the bolt sear 66 can now pivot freely for open bolt operation. The bolt sear 66 is spring biased in a counterclockwise direction, forcing the ends 164 upward, and the camming surface 176 against the selector. Note that the bolt remains closed for the first shot, even as it will transition to open bolt operation for subsequent shots. Firing of the first shot is triggered simply by release of the trigger sear 200 from the hammer hook 182. When the trigger is initially pulled from this position, the firing proceeds as in semiautomatic mode.

Figure 16:
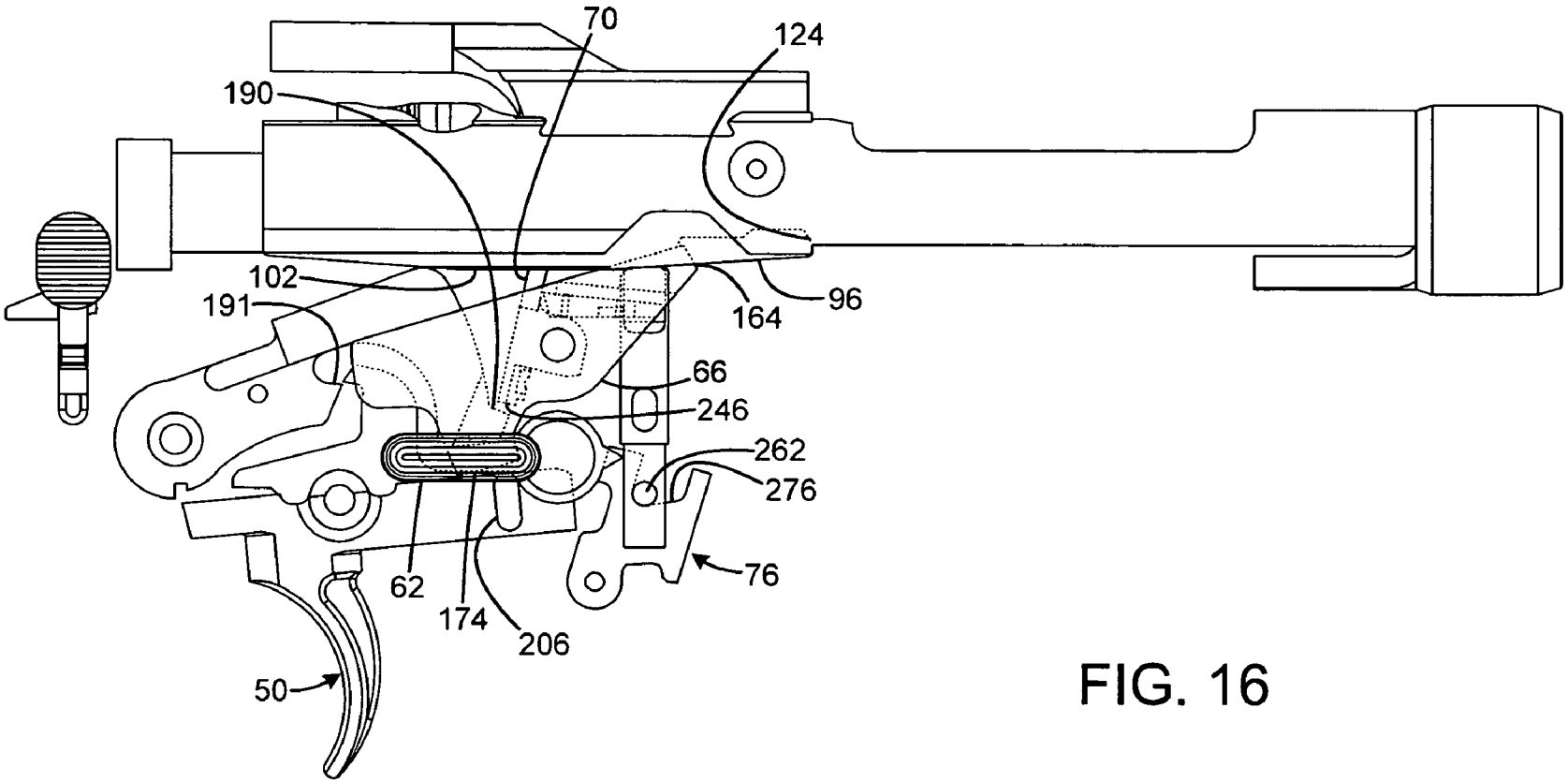

FIG. 16 shows the next stage of operation in fully automatic mode. The selector 62 remains in the fully automatic position. The operator provides a sustained rearward pressure on the trigger in order to provide fully automatic fire. The first shot has been fired, and the bolt assembly 42 has been shifted to the fully open position. Because of the sustained trigger pressure, the boss 204 on the trigger 50 presses upward against the trigger force transfer surface 174 of the left plate of the bolt sear 66. This maintains the rear ends 164 of the bolt sear in a lowered position so that they do not engage the bolt carrier sear engagement surfaces 124 when the bolt assembly is in full recoil. The bottom surfaces 96 and 102 of the bolt carrier act upon the upper end of the reconnector plunger 74, camming it downward so that the pin 262 presses downward against surface 276 of the trigger block 76. This tips the trigger block rearward, so that it is out of engagement with the rear end of the trigger. The selector 62 cams the disconnector out of play, pulling it downward to prevent engagement with the hammer hook 191 by a protrusion 225 shown in FIG. 8. The safety sear 70 is in the safe position, with the lower end surface 246 blocking the hammer end surface 190.

Figure 17:
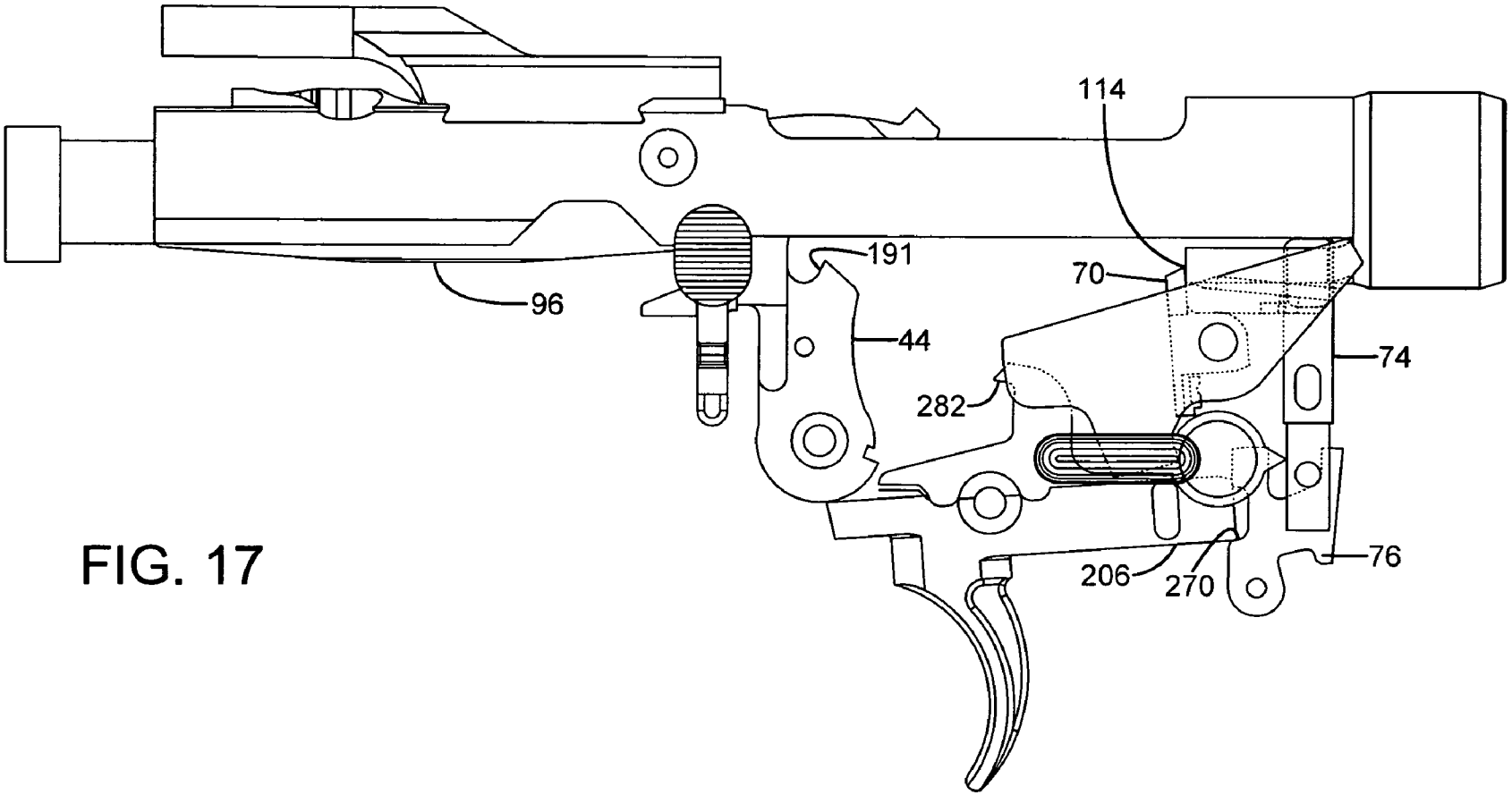

FIG. 17 shows the next stage of operation in fully automatic mode. Trigger pressure is sustained as the bolt has cycled forward for an additional discharge in a fully automatic burst. The bolt has shifted forward in response to the pressure of a compressed recoil spring (not shown) toward the closed position. Just as the bolt nearly reaches the closed position, the carrier protrusion 114 strikes the safety sear 70 on the lower end to release the hammer 44. By the time the hammer has reached and struck the firing pin, the bolt has already fully closed. Because the plunger is no longer being pressed down by the lower ramp 96 of the bolt carrier, it has extended upward under the pressure of its spring, allowing the trigger block 76 to rotate forward under its own spring pressure. This brings the engagement surface 270 of the trigger block forward to a position beneath the rear end 206 of the trigger, preventing the trigger from rotating back out of the firing position as long as the trigger block remains forward. The selector continues to press downward the rear end of the disconnector, rotating the hook 282 to the rear to prevent it from engaging the hammer surface 191. Fully automatic fire continues until ammunition is depleted, or the trigger is released.

Figure 18:
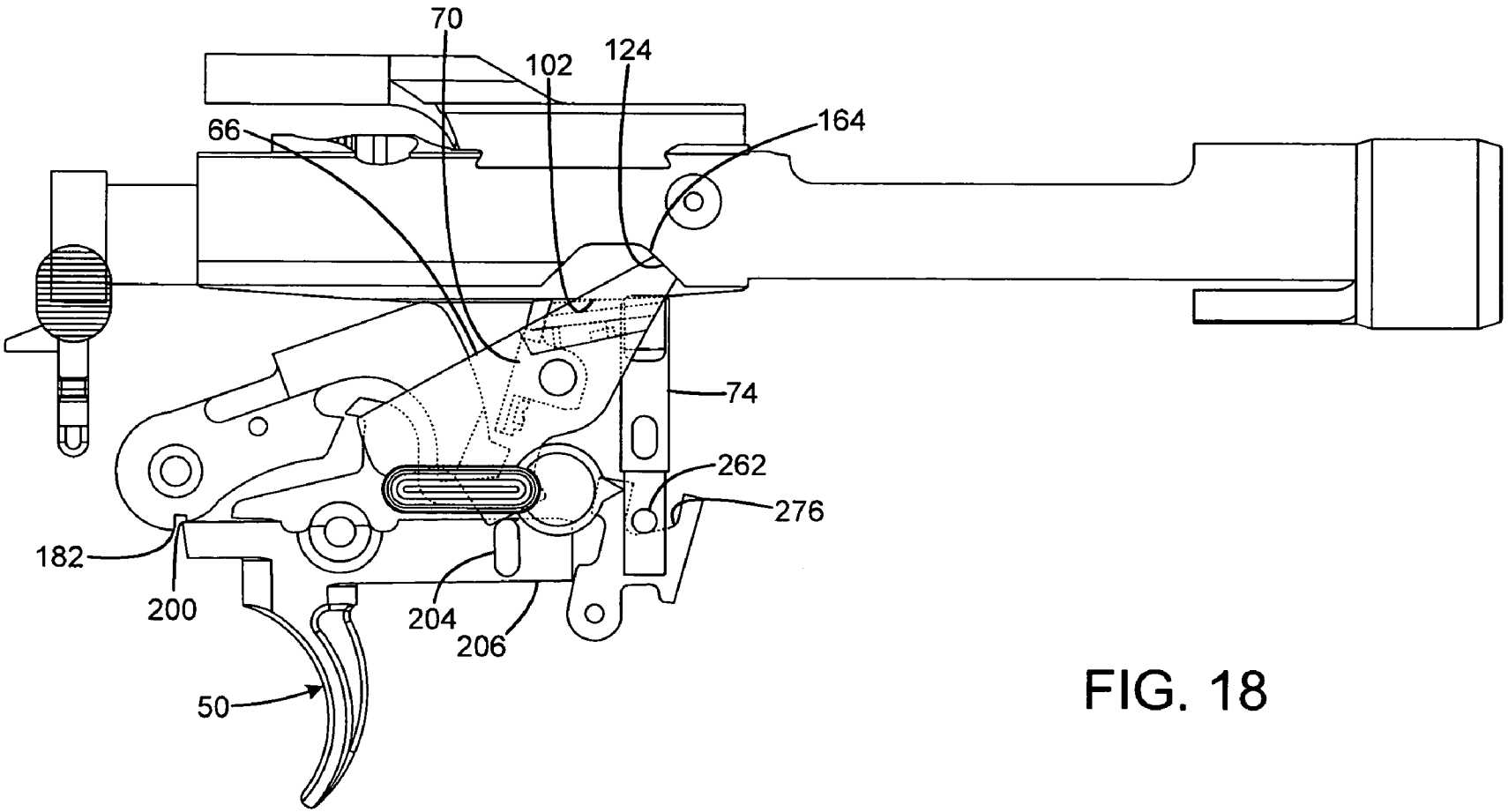

FIG. 18 shows the next stage of operation in fully automatic mode. The trigger has been released at some point in the cycle of the action. If released while the bolt is moving forward, the trigger block maintains the trigger in the firing position so that the next round that is fed into the chamber is fired, as if the operator maintains trigger pressure. However, because the operator had released pressure on the trigger, the trigger is allowed to reset to the non-firing position when the bolt moves rearward sufficiently that the ramp 102 forces the plunger 74 downward. The plunger pin 262 presses down on trigger block surface 276, tipping it rearward, allowing the rear end 206 of the trigger 50 to move downward into the non-firing position. The safety sear 70 has tipped back into the safe position, so that the end of the hammer will be restrained. Because the trigger is in the reset position, the trigger boss 204 has lowered, allowing the bolt sear 66 to tip downward under its spring force at the front end and upward at the rear ends 164. When the bolt has traveled sufficiently rearward, the ends engage the sear engagement surfaces 124, restraining the bolt carrier in the open position.

Figure 19:
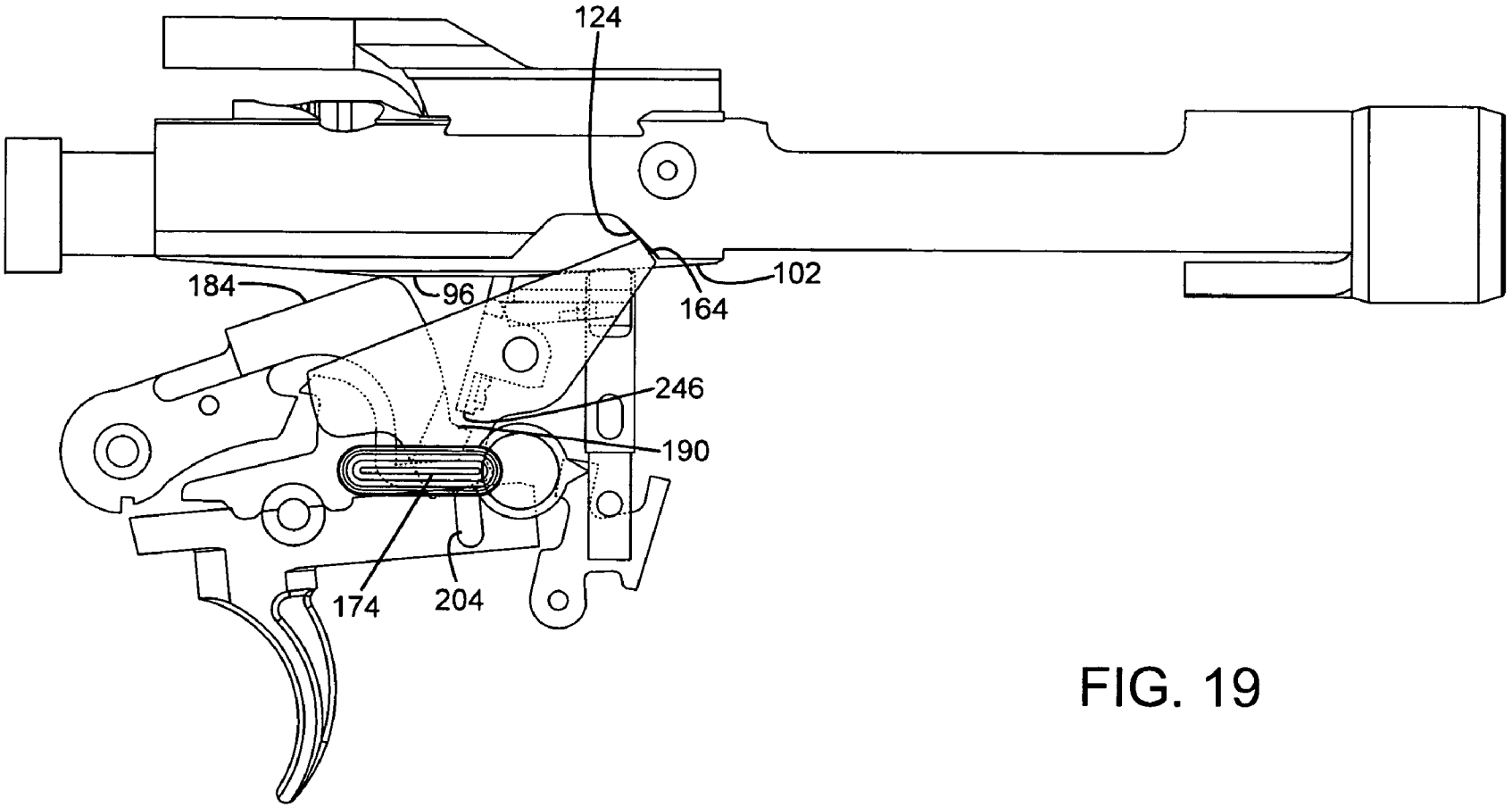

FIG. 19 shows operation in fully automatic mode after the bolt is locked in the open position. When the trigger is pulled, the upward force of the trigger boss 204 on surface 174 of the bolt sear tips ends 164 downward, disengaging the sear from the sear engagement surfaces 124. As the bolt will move forward after disengagement, the bolt surfaces 96, 102 retaining the hammer face 184 will pass, allowing the hammer to begin to swing forward. However, because the safety sear is in the safe condition, the lower end 246 will catch the hammer hook 190, preventing further movement while the bolt proceeds toward the closed position. Firing proceeds as above until the trigger is released.

Figure 20:
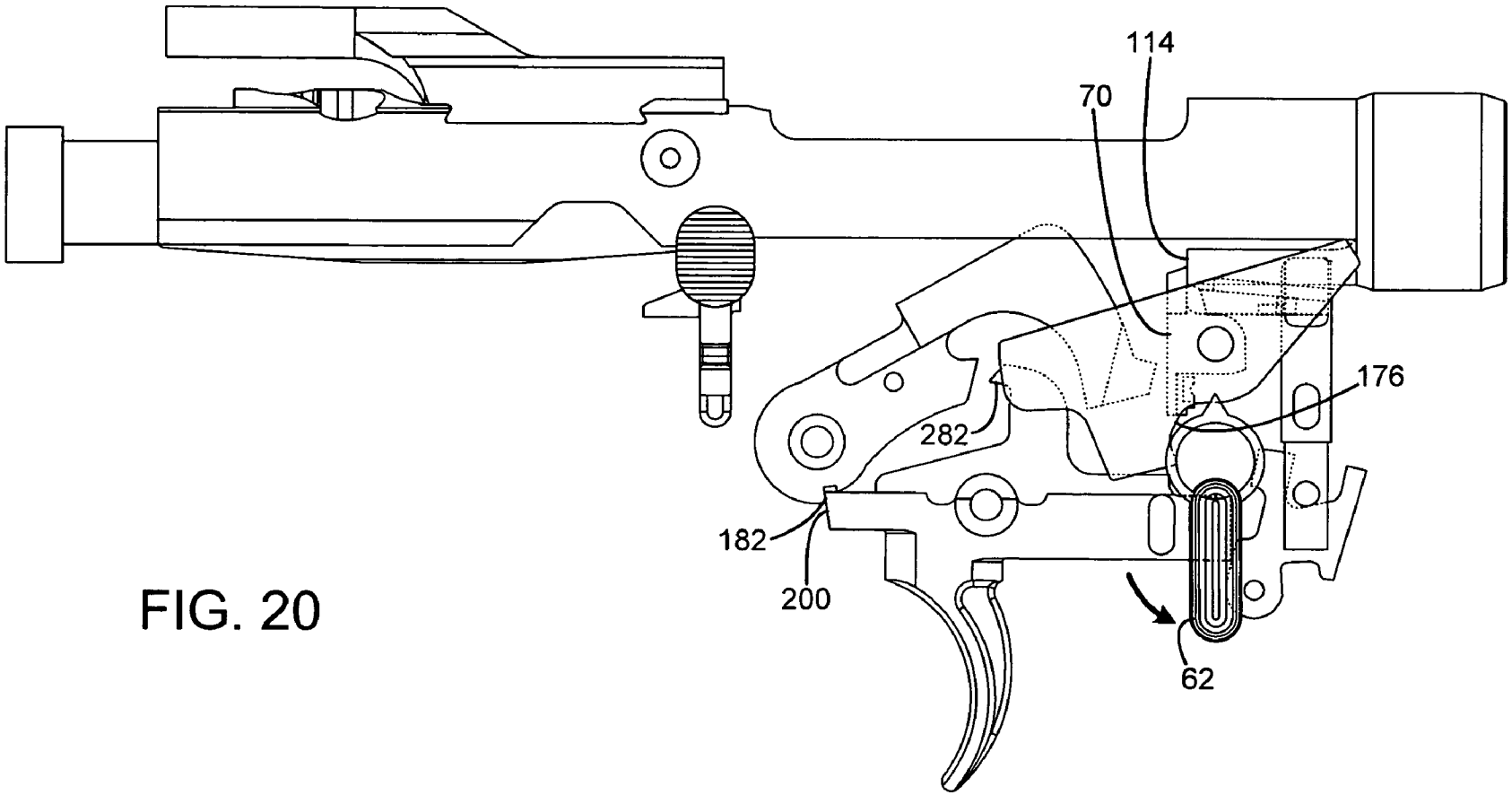

FIG. 20 shows the effect of resetting the selector 62 into the semiautomatic position when the bolt is in a locked open position. The same actions occur if the selector is transitioned to the safe position from the fully automatic position. As the selector is rotated, the selector cams against the bolt sear surface 176 to tip the rear end downward out of engagement with the bolt carrier. This allows the bolt carrier to transition forward to a closed position. As the bolt carrier moves forward, it no longer restrains the hammer, which shifts slightly forward until hammer notch 182 is engaged by the safety sear 70. The safety sear is disengaged by protrusion 114 when the bolt assembly is nearly in battery. This releases the hammer momentarily, until the hammer hook 182 is caught by the trigger sear 200, restraining the cocked hammer. The rotated selector allows the disconnector rear end to rise and disconnector hook 282 to move forward so that it may operate for the next semiautomatic shot in the manner discussed above. The safety sear acts as a failsafe, ensuring that the hammer will not release until the trigger is pulled and the carrier group is in full battery.

One advantage of the illustrated system is that it provides operability in the event of the failure of the carrier sear engagement surfaces 164 or 124 (i.e. sheared, rounded, or broken.) If this occurs the weapon/rifle will safely and automatically revert to closed bolt auto, thus allowing the weapon to continue operation until it can be serviced.

Additional functionality may be obtained by changing the camming surfaces on the selector to add a third mode of operation "closed bolt auto", in which the bolt sear is restrained from engaging the bolt by a lobe on the selector, and the safety sear used to release the hammer on a closed bolt.

If the drop-in unit (Sub-frame with associated components) were to become completely damaged in the field, it could be removed by the user and the weapon will continue to operate in semi-auto mode.

Conversion back to a standard closed bolt (semi and auto) entails merely removing the trigger block, selector and drop-in unit. A standard mil-spec selector and auto sear would need to be installed. The bolt carrier group will work with the standard mil-spec fire control group The magazine-operated last round bolt-hold open remains operable with the disclosed system both in semi-auto and open bolt modes.

While the above is discussed in terms of preferred and alternative embodiments, the invention is not intended to be so limited.

The invention claimed is:

1. A firearm comprising:

a frame;

a barrel connected to the frame and defining a barrel axis;

the barrel having a rear end defining a chamber;

a bolt operable to reciprocate with respect to the chamber between a closed position adjacent the chamber, and an open position away from the chamber;

a fire control assembly including a trigger and a selector switch the fire control assembly including a bolt sear operably engaging the bolt;

a sub-frame connected to the frame and to the bolt assembly sear;

the selector switch including a semi-automatic position and a fully-automatic position;

the fire control assembly being operable when the selector switch is in the semi-automatic position in response to pulling the trigger to discharge the firearm, to chamber a cartridge, and to position the bolt in the closed position; and the fire control assembly being operable when the selector switch is in the fully-automatic position in response to pulling the trigger to discharge the firearm, and to hold the bolt in the open position; and wherein when the bolt is held in the open position and the selector switch is in the fully-automatic position, the fire control assembly being operable in response to moving the selector switch from the fully-automatic position to the semi-automatic position to release the bolt and to feed a cartridge into the chamber.

2. The firearm of claim 1 wherein the fire control assembly is operable when the selector switch is in the semi-automatic position to limit discharging the firearm to discharging a single shot while the trigger is pulled with a sustained force.

3. The firearm of claim 1 wherein the fire control assembly is operable when the selector switch is in the fully-automatic position to repeatedly discharge the firearm while the trigger is pulled with a sustained force, and to cease discharging the firearm in response to cessation of the force on the trigger.

4. The firearm of claim 1 wherein when the bolt is held in the open position and the selector switch is in the fully-automatic position, the fire control assembly being operable in response to pulling the trigger to release the bolt from the open position, to feed a cartridge into the chamber, and to fire the cartridge.

5. The firearm of claim 1 wherein the bolt sear is movable between a disengaged position in which the bolt sear does not engage the bolt assembly, and an engaged position in which the bolt sear engages the bolt to restrain the bolt to the open position, and wherein the selector switch includes a engagement surface operable to restrain the bolt sear to the disengaged position when the selector switch is in the semi-automatic position, and to allow the bolt sear to move between the disengaged position and the engaged position when the selector switch is in the fully-automatic position.

6. The firearm of claim 1 wherein the fire control assembly includes a hammer movable between a cocked position and a released position, and a first sear operably connected to the trigger and operable to restrain the hammer in the cocked position when the selector switch is in the semi-automatic position, such that pulling the trigger releases the hammer to discharge the firearm, and wherein the bolt is operably connected to the trigger, and operable to restrain the bolt in the open position when the selector switch is in the fully-automatic position, such that pulling the trigger releases the bolt to discharge the firearm.

7. The firearm of claim 6 including a safety sear operable when the selector switch is in the fully-automatic position to restrain the hammer in the cocked position when the bolt is released, and wherein the bolt has a safety sear release element operable to contact the safety sear to release the hammer when the bolt is near the closed position.

8. The firearm of claim 6 wherein the safety sear is operable when the selector switch is in the semi-automatic position to restrain the hammer from discharging the firearm in the event the first sear fails to restrain the hammer.

9. The firearm of claim 1 wherein the subframe is formed of a stronger material than the frame.

10. The firearm of claim 9 wherein the subframe is formed of steel, and the frame is formed of aluminum.

11. A firearm comprising:

a frame;

a barrel connected to the frame and defining a barrel axis;

the barrel having a rear end defining a chamber;

a bolt assembly operable to reciprocate with respect to the chamber between a closed position adjacent the chamber, and an open position away from the chamber;

a fire control assembly including a trigger and a selector switch having a semi-automatic position and a fully-automatic position;

the fire control assembly including a hammer movable between a cocked position and a released position;

the fire control assembly including a first sear operably connected to the trigger and operable to restrain the hammer in the cocked position when the selector switch is in the semi-automatic position, such that pulling the trigger releases the hammer to discharge the firearm;

the fire control assembly including a second sear operably connected to the trigger, and operable to restrain the bolt in the open position when the selector switch is in the fully-automatic position, such that pulling the trigger releases the bolt to discharge the firearm;

the fire control assembly including a third sear operable when the selector switch is in the fully-automatic position to restrain the hammer in the cocked position when the bolt is released;

the bolt having a release element operable to contact the third sear to release the hammer when the bolt is near the closed position; and the third sear being operable when the selector switch is in the semi-automatic position to restrain the hammer from discharging the firearm in the event the first sear fails to restrain the hammer when the bolt is not in the closed position.

12. The firearm of claim 11 wherein the hammer is an elongated body pivotally attached at the frame at first end, and wherein the hammer has a sear contact surface at an opposed second end operable to contact the third sear, such that the third sear restrains the hammer.

13. A firearm comprising:

a frame;

a barrel connected to the frame and defining a barrel axis;

the barrel having a rear end defining a chamber;

a bolt assembly operable to reciprocate with respect to the chamber between a closed position adjacent the chamber, and an open position away from the chamber;

a fire control assembly including a trigger and a selector switch;

the selector switch including a semi-automatic position and a fully-automatic position;

the fire control assembly being operable when the selector switch is in the semi-automatic position in response to pulling the trigger to discharge the firearm, to load a cartridge, and to position the bolt in the closed position;

the fire control assembly being operable when the selector switch is in the fully-automatic position in response to pulling the trigger to discharge the firearm, and to hold the bolt in the open position;

the fire control assembly including a trigger block element operably engaged to the trigger and to the bolt to maintain the trigger in a pulled position when the selector switch is in the fully-automatic position and the trigger is released while the bolt moves forward from the open position, such that one more discharge occurs after such a release of the trigger, and the bolt does not chamber a round without discharging the round.

14. The firearm of claim 13 wherein the trigger block element is responsive to bolt position to determine trigger operation.

15. A firearm comprising:

a frame;

a barrel connected to the frame and defining a barrel axis;

the barrel having a rear end defining a chamber;

a bolt operable to reciprocate with respect to the chamber between a closed position adjacent the chamber, and an open position away from the chamber;

a fire control assembly including a trigger and a selector switch the fire control assembly including a bolt sear operably engaging the bolt;

a sub-frame connected to the frame and to the bolt assembly sear;

the selector switch including a semi-automatic position and a fully-automatic position;

the fire control assembly being operable when the selector switch is in the semi-automatic position in response to pulling the trigger to discharge the firearm, to chamber a cartridge, and to position the bolt in the closed position;

the fire control assembly being operable when the selector switch is in the fully-automatic position in response to pulling the trigger to discharge the firearm, and to hold the bolt in the open position;

wherein the fire control assembly includes a hammer movable between a cocked position and a released position, and a first sear operably connected to the trigger and operable to restrain the hammer in the cocked position when the selector switch is in the semi-automatic position, such that pulling the trigger releases the hammer to discharge the firearm, and wherein the bolt is operably connected to the trigger, and operable to restrain the bolt in the open position when the selector switch is in the fully-automatic position, such that pulling the trigger releases the bolt to discharge the firearm; and wherein the trigger has a first sear-engagement surface operable to restrain and release the hammer when the selector is in the semi-automatic position, and wherein the trigger has a second sear-engagement surface operable to restrain and release the hammer when the selector is in the fully-automatic position.

16. A firearm comprising:

a frame;

a barrel connected to the frame and defining a barrel axis;

the barrel having a rear end defining a chamber;

a bolt operable to reciprocate with respect to the chamber between a closed position adjacent the chamber, and an open position away from the chamber;

a fire control assembly including a trigger and a selector switch the fire control assembly including a bolt sear operably engaging the bolt;

a sub-frame connected to the frame and to the bolt assembly sear;

the selector switch including a semi-automatic position and a fully-automatic position;

the fire control assembly being operable when the selector switch is in the semi-automatic position in response to pulling the trigger to discharge the firearm, to chamber a cartridge, and to position the bolt in the closed position;

the fire control assembly being operable when the selector switch is in the fully-automatic position in response to pulling the trigger to discharge the firearm, and to hold the bolt in the open position;

wherein the fire control assembly includes a hammer movable between a cocked position and a released position, and a first sear operably connected to the trigger and operable to restrain the hammer in the cocked position when the selector switch is in the semi-automatic position, such that pulling the trigger releases the hammer to discharge the firearm, and wherein the bolt is operably connected to the trigger, and operable to restrain the bolt in the open position when the selector switch is in the fully-automatic position, such that pulling the trigger releases the bolt to discharge the firearm; and a disconnector element operable when the selector switch is in the semi-automatic position to engage a hook on the hammer to restrain the hammer after discharge, the selector switch including a disconnector restraint surface operable when the selector switch is in the fully-automatic position to restrain the disconnector into an unengageable position in which the hammer hook does not engage the disconnector after discharge.

* * * * *